United States Patent [19]

Buschmann

[11] Patent Number: 4,924,145

[45] Date of Patent: May 8, 1990

[54] MERCURY CAPSULE SUPPORT

[75] Inventor: Jeffrey P. Buschmann, Lexington, Ky.

[73] Assignee: GTE Products Corporation, Danvers, Mass.

[21] Appl. No.: 290,727

[22] Filed: Dec. 27, 1988

[51] Int. Cl.[5] ..... H01J 61/28

[52] U.S. Cl. ..... 313/546; 313/549; 313/561; 313/554; 313/565; 313/490

[58] Field of Search ..... 313/546, 565, 490, 639, 313/571, 547, 549, 553, 554, 561; 445/9, 60, 73

[56] References Cited

U.S. PATENT DOCUMENTS

| | | | |
|---|---|---|---|
| 3,634,717 | 1/1972 | Boucher et al. | 313/490 X |
| 3,913,999 | 10/1975 | Clarke | 313/546 X |
| 4,534,742 | 8/1985 | Grossman et al. | 445/9 |
| 4,539,508 | 9/1985 | Mulder et al. | 313/546 |

*Primary Examiner*—Donald J. Yusko
*Assistant Examiner*—Michael Horabik
*Attorney, Agent, or Firm*—William E. Meyer

[57] ABSTRACT

A lamp including a fill gas with a mercury component may be safely dosed with mercury by including at least one mercury capsule in the envelope for subsequent opening by radiant means to dose the closed envelope with mercury. A spring coil or similar means may be used for supporting the capsule in a tubular envelope at a position independent of and separated from the press-seal area. The support means generally comprises a compression positioning member, preferably in the form of a coil spring, having the capsule or capsules secured thereto and further having an uncompressed state prior to insertion in the envelope and a compressed state upon insertion in the envelope for retention of the compression positioning member and as a result, the mercury capsule, in a substantially fixed position in the envelope. Once the capsule is in position, the lamp may be safely closed, and the capsule opened by inductive, or other radiant heating.

2 Claims, 4 Drawing Sheets

MERCURY CAPSULE SUPPORT

BACKGROUND OF THE INVENTION

1. Field of the Invention

The present invention relates in general to rare gas filled lamp constructions, and in particular arc discharge lamp constructions employing a mercury capsule for dispensing mercury into the lamp envelope. More particularly, the present invention relates to an improved means for the support and positioning of the mercury capsule in the lamp envelope.

2. Background Discussion

In the early construction of mercury filled lamps, mercury was introduced into a lamp as a liquid. Mercury doping is still commonly carried out by dispensing machines. During the exhaust cycle prior to lamp sealing, the machines dispense beads of mercury, from a reservoir, through a needle directly into the lamp. Dispensing mercury even by machine can be difficult. Mercury may be spilled during normal handling, because of machine error, or during machine repair. Spilled mercury shatters and rolls, but is not absorbed, making cleanup difficult.

With a greater stress on environmental protection, mercury is more frequently being enclosed in a capsule. The capsule is inserted in the lamp, and forced to open once the lamp is closed. The mercury capsule then holds and controls the mercury during assembly and thereby helps eliminate the handling and machine related problems.

The mercury capsule is typically inserted into the lamp during manufacture as an appendage of the lamp filament or lamp seal structure. In this regard, by way of example, refer to U.S. Pat. Nos. 3,913,999 to Clarke; 4,534,742 to Grossman, et al; and 4,539,508 to Mulder, et al. The above-referenced patents show different arrangements, all of which suspend the mercury capsule in one manner or another from the electrode structure, basically at or close to the lamp seal area. Once the lamp is closed, the mercury is released by heating the capsule during light up. The heating may come from the nearby filament or from a separate external heating source, such as an RF heat. Heat causes the mercury pressure to increase in the metal capsule. With sufficient pressure the capsule opens, expelling the mercury safely into the sealed lamp.

A further illustration of a standard mercury capsule support is shown in the prior art drawing of FIG. 1. FIG. 1 illustrates a standard fluorescent lamp with a mercury capsule. The view of FIG. 1 is a fragmentary view of one end of a fluorescent tube illustrating the tubular envelope 10 having a flame seal area at 12 and further illustrating an electrode at 14. FIG. 1 shows the mercury capsule 16 being supported as an extension of the structure of coil 14 by means of a support wire 18.

In connection with the lamp construction of FIG. 1, the fluorescent lamp typically uses a relatively soft glass such as type 080 soft glass, requiring approximately 800° C. to seal a 3 to 4 millimeter wide area such as shown at the press-seal area 12 at FIG. 1. Thus, a relatively low heat level is required to seal the envelope, and the low heat does not reach the mercury capsule disposed on the support wire 18, on the opposite side of coil 14.

Lamps used in high temperature applications; however, use high temperature glasses, and sealing areas can be as long as 23 millimeters. Sealing may also involve temperatures reaching as high as 2000° C. The extreme heat travels up the mount and glass and can cause the mercury capsule to prematurely open during the press-seal operation when a mounting arrangement typical of the prior art shown in FIG. 1 is used. Premature rupture of the mercury capsule may result in improperly dosed lamps, but more importantly, may be hazardous to plant and personnel. There is then a need to safely provide mercury doses in lamps, and in particular, in lamps made with high temperature seals.

DISCLOSURE OF THE INVENTION

Accordingly, it is an object of the present invention to provide an improved means for support and positioning of a mercury capsule, particularly in tubular lamps and in a manner to prevent premature rupture of the mercury capsule during lamp sealing operations.

Another object of the present invention is to provide a support and positioning means for mercury capsules in high temperature tubular lamp constructions without exposing the mercury capsule to high temperatures that occur during the sealing process.

A further object of the present invention is to provide a positioning means for one or more mercury capsules in which the positioning means is not secured to the electrode or coil mount but is instead independently supported spaced therefrom.

To accomplish the foregoing and other objects, features and advantages of this invention, there is provided in accordance with one aspect of the invention, a lamp adapted to have a mercury fill and comprising a tubular envelope, and an electrode or coil means supported at at least one end of the envelope by a press-seal area of the envelope. The tubular envelope is adapted to contain a rare gas fill after being sealed. There is provided at least one sealed mercury capsule and means for supporting the mercury capsule in the tubular envelope at a position independent of and separated from the press-seal area of the envelope. The support means preferably comprises a compression positioning means having the dispensing capsule secured thereto. The compression positioning means, in the preferred embodiment comprises a metal coil spring having an uncompressed state prior to insertion into the tubular envelope and a compressed state upon insertion into the tubular envelope to retain the coil spring, and in turn, the mercury capsule, in a basically fixed position in the tubular envelope.

In accordance with further features of the present invention, the tubular envelope may have an electrode or coil and associated press-seal area at each end of the tubular envelope. In this instance, the compression positioning means, or preferred coil spring is disposed intermediate the press-seal areas and is positioned independent and spaced from either of the press-seal areas. The compression positioning means may be disposed substantially mid-way between the end press-seal areas. The compression positioning means may also be adapted to support a pair of mercury capsules, one disposed at each end thereof. The capsules, in the instance where a coil spring is used, may be welded to the free ends of the coil spring. The coil spring is preferably constructed of a metal material such as molybdenum.

In accordance with a further aspect of the present invention, there is provided a method of constructing a rare gas filled lamp from a tubular envelope open at least at one end. The method comprises the steps of providing a mercury capsule, providing a compression positioning means and securing the mercury capsule to the compression positioning means. The capsule and compression positioning means are then inserted into the tubular envelope through an open end thereof to a position sufficiently remote from the open end and by means of compressing the compression positioning means. Next, there is provided an electrode or coil means. The electrode or coil means is disposed at the open end of the envelope. The electrode or coil means is press-sealed to seal the lamp. The envelope is then evacuated and filled with a rare gas, and closed. Lastly, the mercury capsule is heated in the closed lamp by, for example, inductive heating to open the capsule and expel the sealed mercury in the closed envelope.

BEST MODE FOR CARRYING OUT THE INVENTION

For a better understanding of the present invention together with other and further objects, advantages and capabilities thereof, reference is made to the following disclosure and appended claims in connection with the drawings.

Figure 1:
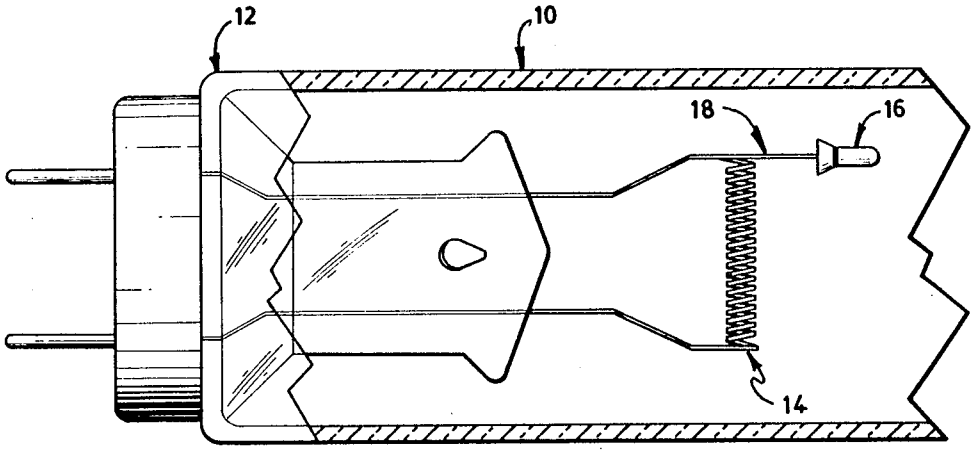
PRIOR ART FIG. 1
FIG. 1 as prior art is a fragmentary view of a standard fluorescent lamp with the mercury capsule supported from a coil of the lamp.

As indicated in the background discussion, FIG. 1 illustrates one end of a standard fluorescent lamp and the manner in which a mercury capsule, such as the capsule 16 illustrated in FIG. 1, is supported from an coil 14 of the fluorescent lamp. The prior art support method may be suitable for low temperature applications, but there are many high temperature applications that require high temperature glasses and seals for the envelope. For example, Vycor or quartz germicidal lamps use high temperature glasses. Germicidal lamps operate like fluorescent lamps except there is no phosphor coating, so the ultraviolet radiation passes directly through the glass to sterilize the illuminated area. Such germicidal lamps are used, for example, to disinfect sewage in water treatment facilities.

For applications in which the envelope uses high temperature glass, the concepts of the present invention are particularly advantageous, although, the principles of the present invention may be used with many lamp envelope constructions, preferably tubular envelope constructions.

Figure 2:
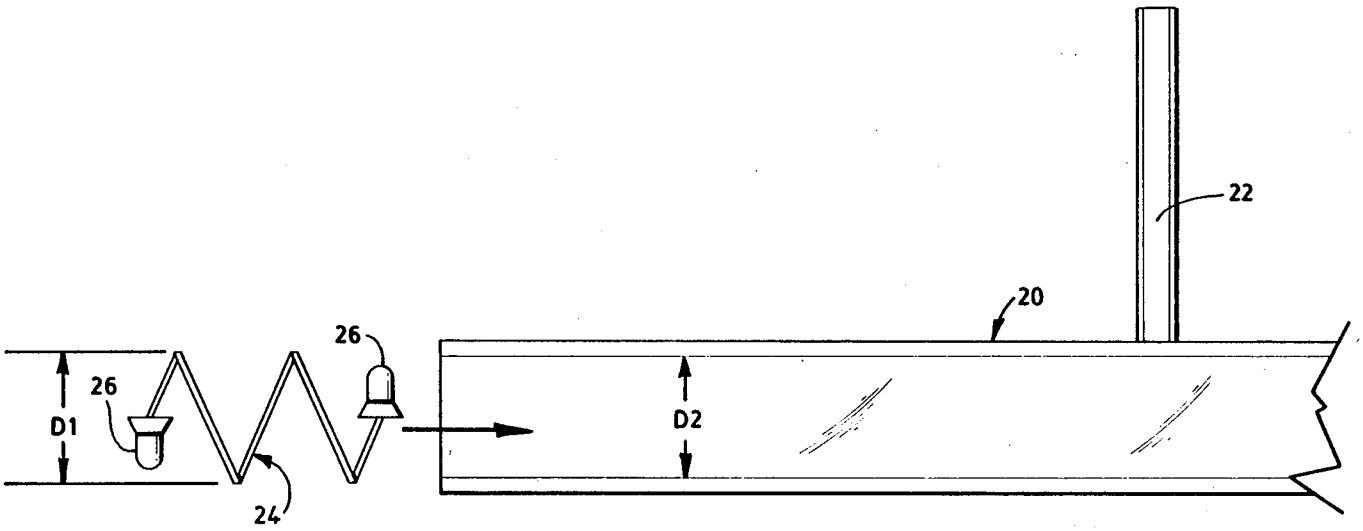
FIG. 2 illustrates the tubular lamp envelope and the compression positioning means of the present invention in the form of a spring coil having a pair of mercury capsules secured thereto prior to assembly.

Reference is now made to FIG. 2 for an illustration of an initial step in the construction of a tubular lamp. The lamp may be an arc discharge lamp. FIG. 2 illustrates the envelope in the form of a quartz lamp tube 20 that is open at either end and, in the particular embodiment disclosed in FIG. 2, has a quartz exhaust tube 22 extending from about the mid-point along the length of the lamp tube 20.

FIG. 2 also illustrates the compression positioning means of the present invention in the form of a coil spring 24 shown in its natural or rest, uncompressed, position. In this position, the coil spring 24 has a maximum coil diameter D1 that is greater than the inner diameter D2 of the quartz lamp tube 20. FIG. 2 also shows the mercury capsules 26 secured to the ends of the coil spring 24. The mercury capsules 26 may be secured by mechanical means or by welding to the ends of the coil spring.

Figure 3A:
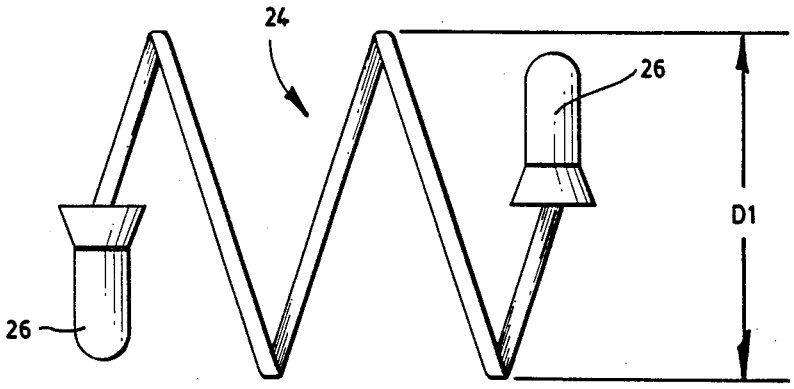
FIGS. 3A and 3B are respective side and end views of the spring coil and the attached mercury capsules.
Figure 3B:
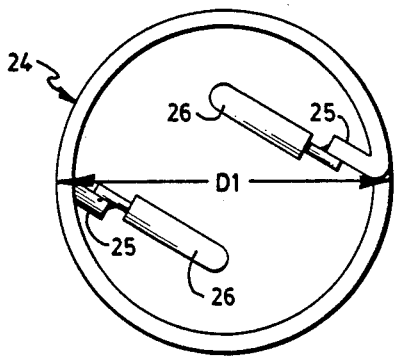

FIG. 3A shows a side view of a coil spring 24 with mercury capsules 26 welded to the free ends. The coil spring 24 has two turns, and extends for an axial length somewhat greater than the diameter D1 of the coil spring 24. While the coil spring 24 may be formed with zero pitch and as little as half a turn, the preferred coil spring 24 has sufficient pitch, and number of turns to prevent the coil spring 24 from being twisted or cocked in the lamp tube 20. Applicant prefers a coil spring 24 of two or three turns at three or four turns per inch. The pitch and length of the coil spring 24 is felt to be adaptable to the particular lamp chosen by the user. Applicant further prefers to minimize the material, and axial cross section of the coil spring 24 to limit any interference with the arc discharge. FIG. 3B in shows an axial view of the coil spring 24 with the mercury capsules 26 welded to end ears 25 at the free ends of the coil spring 24. The ears 25 are turned inwardly from the natural diameter of the coil spring 24. The ears 25, however, are preferably relatively short and once the mercury capsule has been exploded, they provide little interference with the normal arc discharge in the lamp.

The coil spring 24 is made of any metal which is compatible with the individual lamp's fill gas and the lamp's mode of operation. In the illustrated embodiment, the spring 24 is constructed of molybdenum. Alternatively, the material for the coil spring 24 may be made from, or include a getter material such as tantalum or zirconium to getter, for example free oxygen.

Figure 4:
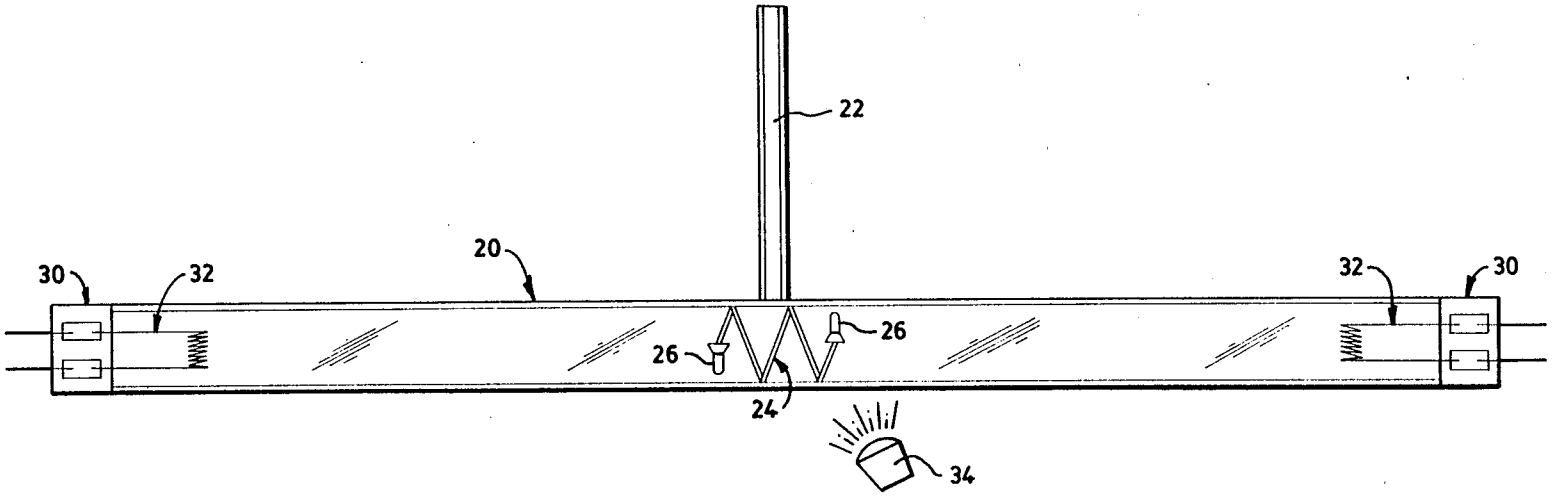
FIG. 4 is a final view of the lamp near completion of its construction and illustrating in particular the position of the coil spring supporting the mercury capsules as it relates to the press seal areas of the tubular lamp.

FIG. 2 illustrates the coil spring 24 and the attached mercury capsules 26 about to be inserted into the quartz lamp tube 20. As indicated, the outer diameter D1 of the coil spring 24 is greater than the inner diameter D2 of the quartz lamp tube 20. For insertion of the coil spring, the coil spring is compressed and inserted into the quartz lamp tube 20. Once in position in the lamp tube 20, the coil spring expands, compressing against the lamp tube 20 to hold the coil spring 24 and attached mercury capsules 26 in place. FIG. 4 shows the spring coil 24 in the compressed state and positioned at about the midpoint of the quartz lamp tube 20. In this construction the spring coil 24 may be compressed by hand or by a small compression member. The spring coil 24 and attached mercury capsules 26 may then be moved along in the lamp tube 20 by a plunger or similar means.

Again, by virtue of having the spring diameter greater than the inner diameter of the quartz tube, when the spring coil 24 is inserted, it expands into firm contact with the inner wall of the quartz lamp tube 20. Thus, the coil spring 24 compressively abuts the inner surface of the lamp tube envelope, and has sufficient lateral spread and is dimensioned relative to the inner diameter of the tubing so as to laterally spread but not twist or slide once in position. In this regard, it is preferred that the coils of the spring coil 24 be substantially open as illustrated.

With further reference to FIG. 4, once the coil spring 24 and the attached mercury capsules 26 have been inserted into the lamp tube 20, the lamp tube 20 is then press-sealed as indicated in FIG. 4 at 30, thus sealing the mounts 32 in the ends of the lamp envelope. The lamp tube 20 is then exhausted via the exhaust tube 22, sealing the operating gas in the lamp. By way of example, the operating gas may be argon. The lamp of FIG. 4 is shown as having coil type electrodes, but structure of the particular electrodes is not felt to affect the spring coil 24 design, and use of the mercury capsule support with any lamp electrode type is expected.

Once the lamp is sealed and exhausted, the mercury capsules 26 may then be opened up by an inductive or similar heater to release the mercury in the lamp. FIG. 4 schematically illustrates an induction heating device at 34. After the mercury capsules 26 have been opened to release the mercury, the lamp may be lighted and finished.

While there have been shown and described what are at present considered the preferred embodiments of the invention, it will be obvious to those skilled in the art that various other changes and modifications may be made therein without departing from the scope of the invention as defined by the appended claims.

What is claimed is:

1. A lamp having a mercury fill component comprising, an envelope having electrodes and associated press-seal areas at opposite ends of the envelope, the envelope adapted to contain a rare gas fill after sealing, a compressible coil spring disposed substantially midway intermediate the press-seal areas and positioned independent of and spaced from the press-seal areas and at least one sealed mercury capsule openable at a distance by radiant means and disposed at an end of the coil spring, the coil spring having an uncompressed state prior to insertion in the envelope and a compressed state upon insertion in the envelope for retention of the coil spring and in turn the mercury capsule in a fixed position in the envelope.

2. In a rare gas tubular envelope, a mercury capsule adapted to be positioned in the envelope for subsequent opening to dose the envelope with mercury, the improvement comprising, means for supporting the mercury capsule at a position independent of and separated from a press-seal area, the means for supporting comprising a metal coil spring for holding the capsule and having a diameter greater than the inner diameter of the tubular envelope during an uncompressed state prior to insertion into the tubular envelope and a compressed state upon insertion into the tubular envelope for retention of the compression positioning means and in turn the mercury capsule in a fixed position in the tubular envelope.

* * * * *